US005398288A

United States Patent [19]

Kizak

[11] Patent Number: 5,398,288

[45] Date of Patent: Mar. 14, 1995

[54] COAXIAL LOUDSPEAKER SYSTEM

[75] Inventor: Ulrich Kizak, Niederwinkling, Germany

[73] Assignee: Nokia Technology GmbH, Pforzheim, Germany

[21] Appl. No.: 100,473

[22] Filed: Aug. 2, 1993

[30] Foreign Application Priority Data

Aug. 5, 1992 [DE] Germany ..... 9210463 U

[51] Int. Cl.[6] ..... H04R 25/00

[52] U.S. Cl. ..... 381/186; 381/199; 381/205

[58] Field of Search ..... 381/199, 186, 205, 188

[56] References Cited

U.S. PATENT DOCUMENTS

| | | | |
|---|---|---|---|
| 4,451,928 | 5/1984 | Murayama | 381/86 |
| 4,465,905 | 8/1984 | Nation . | |
| 4,821,331 | 4/1989 | Murayama et al. . | |
| 4,837,839 | 6/1989 | Andrews | 381/199 |
| 5,081,684 | 1/1992 | House . | |

FOREIGN PATENT DOCUMENTS

| | | |
|---|---|---|
| 3002843 | 7/1981 | Germany . |
| 9005435 | 5/1990 | WIPO . |

*Primary Examiner*—Curtis Kuntz
*Assistant Examiner*—Sinh Tran
*Attorney, Agent, or Firm*—Ware, Fressola, Van Der Sluys & Adolphson

[57] ABSTRACT

Coaxial loudspeaker arrangements (10) are usually so configured, that the loudspeaker (12) located in the bellmouth (29) of the conical loudspeaker (11), is placed on the pole core (17) of the conical loudspeaker (11). However, the contact of the loudspeaker (11) has a disadvantage, with respect to automated manufacture, because either the connection cables (24) for loudspeaker (12) must be threaded through the pole core (17), or the connection cables (24) must be connected to the soldering joints in the diaphragm (15). It is also known to place the loudspeaker (12) into a preform, and to attach this preform to the edge of the loudspeaker frame (14) of the conical loudspeaker (11). The latter is very costly and detrimental to the acoustical effect. For that reason the invention has the task of indicating a coaxial loudspeaker arrangement (10), which is simplified with respect to automated manufacture, without impairing the acoustical effect. This task is fulfilled in that the pole core (17) of loudspeaker (11) is tube-shaped, that the loudspeaker (12) is connected to a receiving arbor (22), and that the shaft (23) of the receiving arbor (22) is pushed into the pole core (17) of the loudspeaker (11), and is securely attached thereto. If the shaft (23) is hollow, the components for a frequency crossover can be integrated into the inside of the shaft (23).

3 Claims, 1 Drawing Sheet

COAXIAL LOUDSPEAKER SYSTEM

TECHNICAL FIELD

The invention concerns coaxial loudspeaker systems or arrangements, particularly the arrangement of the loudspeakers that form the coaxial loudspeaker system with each other, and their contacts.

BACKGROUND OF THE INVENTION

Coaxial loudspeaker arrangements have been known for a long time in the state of the art, so that an extensive explanation of this arrangement can be omitted in this instance.

It is characteristic of a coaxial loudspeaker arrangement that a second loudspeaker, which is smaller than the first loudspeaker, is located inside a first (conical) loudspeaker. Since in the usual applications the conical loudspeaker is a low-frequency loudspeaker, and the other loudspeaker that is located in the bellmouth is a high-frequency loudspeaker, this type of assembly of a coaxial loudspeaker system will be maintained in the following explanation. However, this does not restrict the assembly to the above described type. Rather, the conical loudspeaker can also be configured as a medium-frequency loudspeaker.

The second (high-frequency) loudspeaker located in the bellmouth can be configured as a conical, as well as a hemispherical high-frequency loudspeaker.

The state of the art essentially recognizes two configurations for the arrangement of the high-frequency loudspeaker in the bellmouth of the first loudspeaker.

According to a known configuration, the magnet system of the high-frequency loudspeaker is placed directly on the pole core of the conical loudspeaker. As a rule, the connection of the two above mentioned components is an adhesive connection. The contact of the high-frequency loudspeaker with the connector block of the loudspeaker system is most often arranged so that the loudspeaker's connection cables extend to the soldering terminals located in the bellmouth of the conical loudspeaker, where they are soldered. As is generally known, this type of high-frequency loudspeaker contact has disadvantages, because the movement of the conical diaphragm places considerable mechanical stresses on the connection lines of the high-frequency loudspeaker, and on the soldered joint. In addition, this type of contact requires a series of costly operating steps.

According to another type of high-frequency loudspeaker contacts, which are connected with the pole core of the conical loudspeaker, the connection wires for the high-frequency loudspeaker are threaded through a hole in the pole core of the conical loudspeaker. This type of contact, however, is very expensive with regard to the automated production of coaxial loudspeaker arrangements. The reason is that the high-frequency loudspeaker must be held by a tool during connection to the conical loudspeaker, and that another tool must be available, which is able to thread the high-frequency loudspeaker connection cables through the hole in the pole core.

If the signal path of the high-frequency loudspeaker contains a frequency crossover, the latter is either located on the high-frequency loudspeaker housing, or the housing of the conical loudspeaker, depending on the configuration of the above indicated lines. As can easily be seen, besides requiring a special space, this arrangement of the frequency crossover in the indicated areas sometimes requires additional soldering operations.

In addition to this configuration of coaxial loudspeaker systems, other coaxial loudspeaker systems are known, in which the high-frequency loudspeaker is located in a preform. The preform is attached to the edge of the conical loudspeaker so that it locates the high-frequency loudspeaker above the conical diaphragm in the bellmouth. In this instance, reference is made to U.S. Pat. No. 4,465,905, for example. The contact of these high-frequency loudspeakers is made by connection lines, which are placed in the preform or in the housing of the conical loudspeaker. The frequency crossover may be integrated into the preform or into the preform frame. Although this type of conical loudspeaker arrangement is advantageous for the automated production of the system, it is however considered a disadvantage that the preform, into which the high-frequency loudspeaker is inserted, covers a large portion of the free radiation surface of the conical diaphragm, which reduces the reproduction quality of the coaxial loudspeaker system.

For that reason, the invention has an object of presenting a coaxial loudspeaker arrangement, which can be automatically manufactured in a simple manner, and which has an improved sound reproduction.

SUMMARY OF THE INVENTION

This task is fulfilled by a coaxial loudspeaker with a first conical loudspeaker and with a second loudspeaker, which is located in the bellmouth of the first loudspeaker, where the second loudspeaker is connected to the pole core of the first loudspeaker in that the pole core of the first loudspeaker is tube-shaped, that the second loudspeaker is connected to a receiving arbor, and that the shaft of the receiving arbor is pushed down to the bottom of the pole core of the first loudspeaker, and is securely attached thereto.

The fact that the second high-frequency loudspeaker is connected to the receiving arbor, makes it possible to manufacture the high-frequency unit entirely separately, and to simply connect it to the conical loudspeaker. This is especially simple, and therefore easily automated, because, to connect both loudspeakers, the high-frequency loudspeaker located on the receiving arbor only needs to be inserted into the pole core of the conical loudspeaker with the shaft of the receiving arbor.

If the connection lines for the second (high-frequency) loudspeaker are guided by the connection contacts of this loudspeaker through the inside of the receiving arbor and exit from the receiving arbor at the bottom of the shaft, it has the advantage that, after the loudspeakers have been connected, the high-frequency loudspeaker is very easy to connect with the connector block of the coaxial system.

Since the receiving arbor shaft is hollow, the components for a frequency crossover can be located therein. This has the advantage that no special space is required for these components.

Any penetration of particles into the air gap of the conical loudspeaker is prevented, if the widest diameter of the conical loudspeaker's bellmouth may be covered by a plastic fabric.

This plastic fabric does not impair the reproduction of the coaxial system, if the sum of all thread surfaces covering the bellmouth is a maximum of 25% of the covered surface.

These and other objects, features and advantages of the present invention will become more apparent in light of the detailed description of a best mode embodiment thereof, as illustrated in the accompanying drawing.

BEST MODE FOR CARRYING OUT THE INVENTION

The invention will now be described in greater detail by means of both figures.

Figure 1:
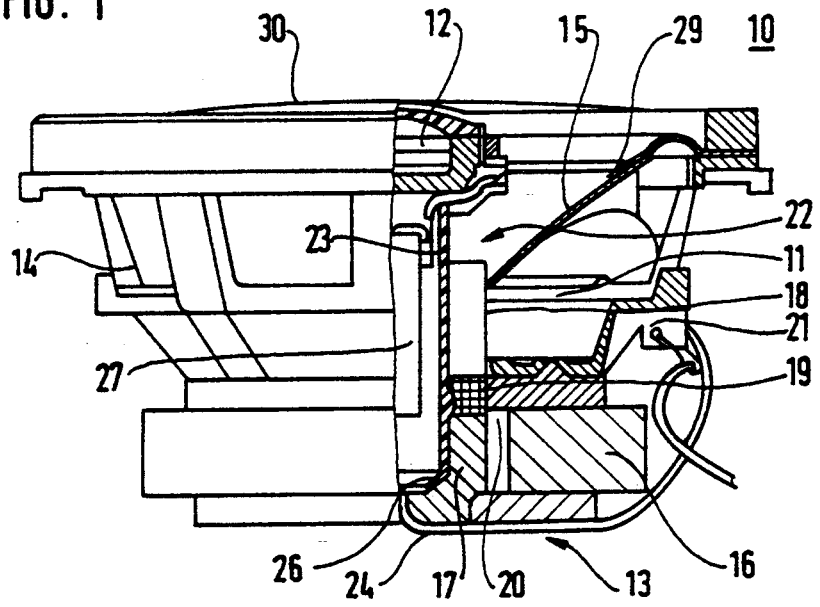
FIG. 1 shows a side view of a coaxial loudspeaker arrangement, according to the invention wherein the right side of this arrangement is open.

FIG. 1 shows a coaxial loudspeaker arrangement 10. This arrangement 10 consists of a conical loudspeaker 11 and a hemispherical high-frequency loudspeaker 12. The essential components of the conical loudspeaker 11 are the magnet system 13, the loudspeaker frame 14 and the diaphragm 15. The magnet system 13 is formed by a ferrite ring 16 and the pole core 17. The end of the voice coil support 18, which carries the voice coil 19, extends into the air gap 20 of the conical loudspeaker 11, and its other end is connected to the diaphragm 15. The connection block 21 for the coaxial loudspeaker system 10 is located on the side of the loudspeaker frame 14. As is clearly shown in FIG. 1, the pole core 17 is essentially tube-shaped. The hemispherical high-frequency loudspeaker 12 is connected to the upper receiving arbor 22, which may be made of plastic. The shaft 23 of the receiving arbor 22 is pushed down to the bottom of the pole core 17 and is attached thereto.

Figure 2:
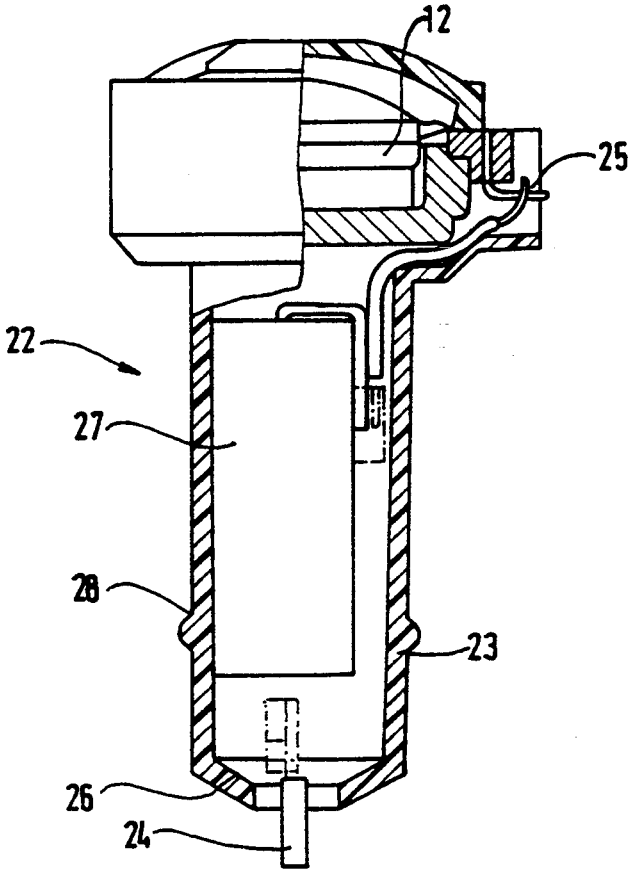
FIG. 2 shows a side view of a receiving arbor, according to the invention in which most of this receiving arbor is open.

The configuration of the receiving arbor 22 is shown in greater detail in FIG. 2. It can clearly be seen that the connection lines 24, which are connected to the contact clamps 25 of the hemispherical high-frequency loudspeaker 12, lead through the inside of the hollow shaft 23 to the bottom 26, and exit there from the bottom 26. In the configuration example shown here, the condenser 27 forming the frequency crossover is integrated into the inside of the shaft 23, and is connected to the signal path of connection lines 24. If required, the condenser 27 may be omitted in another configuration example, not shown here. In that case the connection lines 24 lead directly to the bottom 26 of the receiving arbor 22.

An annular enlargement 28 is formed on the outer periphery of the otherwise smooth shaft 23. If the receiving arbor 22, in the completed condition shown in FIG. 2, is pushed with shaft 23 into the tubular opening of pole core 17, the enlargement has the task of locking shaft 23 in a hollow groove in pole core 17. This locking is shown in FIG. 1 and depicts how the enlargement 28 of shaft 23, in its final position in pole core 17, locks into a hollow groove on the inside of pole core 17. In another configuration example not shown here, the connection of shaft 23 and pole core 17 may also be a purely adhesive attachment. In the representations according to FIGS. 1 and 2, the connection lines 24, which exit from the bottom 26 of the receiving arbor 22, are flexible lines. As illustrated in FIG. 1, this permits a direct attachment of the connection lines 24 to the connection block 21 of system 10.

If required, the contacting part exiting from the bottom 26 may also be a rigid contact plug (not shown). Such contact plugs permit the coaxial loudspeaker 12 to be connected by means of corresponding receptacles (not shown) .

As shown in FIG. 1, the bellmouth 29 of the conical loudspeaker 11 may be covered at its widest diameter by a plastic netting 30, which has a thread thickness of 0.23 mm and a warp of 9 threads per cm and a woof of 14 threads per cm. The netting 30 effectively prevents the intrusion of particles into the air gap 20, without detrimentally affecting the acoustical effect of the system 10, since the sum of all thread surfaces in this type of woven fabric only covers less than 25% of the surface of bellmouth 29.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. A coaxial loudspeaker, comprising:

a receiving arbor;

a first loudspeaker having a pole core; and a second loudspeaker, which is located in the first loudspeaker, and wherein the pole core of the first loudspeaker is tube-shaped, the second loudspeaker is connected to the receiving arbor and a shaft of the receiving arbor is seated in the pole core of the first loudspeaker, and is securely attached to the pole core, an opening of the first loudspeaker is covered by a plastic fabric, and threads of the plastic fabric have a thickness of 0.23 millimeters, a warp of the plastic fabric comprises nine threads per centimeter and a woof of the plastic fabric comprises fourteen threads per centimeter.

2. A coaxial loudspeaker according to claim 1, wherein connecting lines for the second loudspeaker run from connection contacts of the second loudspeaker through an inside of the shaft of the receiving arbor, and exit the receiving arbor through a seated end of the shaft.

3. A coaxial loudspeaker according to claim 2, wherein a frequency crossover for the second loudspeaker is integrated into the inside of the shaft of the receiving arbor.

* * * * *